United States Patent [19]

Picou

[11] Patent Number: 4,614,378

[45] Date of Patent: Sep. 30, 1986

[54] PORTABLE REVERSIBLE CHAIR APPARATUS

[76] Inventor: Ken Picou, 5508 Montview, Austin, Tex. 78756

[21] Appl. No.: 724,671

[22] Filed: Apr. 18, 1985

[51] Int. Cl.[4] ..... A47C 13/00

[52] U.S. Cl. ..... 297/92; 297/19; 297/56; 297/118; 297/429

[58] Field of Search ..... 297/19, 55, 56, 92, 297/111, 118, 188, 423, 429

[56] References Cited

U.S. PATENT DOCUMENTS

| | | | |
|---|---|---|---|
| 876,023 | 1/1908 | Schurger et al. | 297/188 X |
| 2,666,210 | 1/1954 | Wiley | 297/118 X |
| 3,669,493 | 6/1972 | Vowles | 297/429 |

FOREIGN PATENT DOCUMENTS

| | | | |
|---|---|---|---|
| 15208 | of 1885 | United Kingdom | 297/118 |

OTHER PUBLICATIONS

Washington Post Magazine Feb. 19, 1984.

*Primary Examiner*—Francis K. Zugel
*Assistant Examiner*—Peter R. Brown
*Attorney, Agent, or Firm*—John Nevin Shaffer, Jr.

[57] ABSTRACT

A portable reversible chair apparatus with pivotal connections enabling the device to be converted from a "posture" chair configuration to a conventional chair configuration simply and quickly. While the device is in the "posture" chair configuration adjustments are possible that allow users of different size to select the seat angle and the seat to knee rest distance which is most comfortable for them. The knee rest is designed to flex in the verticle plane allowing the seated user to shift weight and position comfortably and safely. The critical joints of the chair pivot thus eliminating racking of joints. Rigidity is derived from triangulation rather than from the size of the joints. The device is very stable due to its large base and sits well on an uneven surface because it rests on three points rather than the traditional four.

6 Claims, 10 Drawing Figures

PORTABLE REVERSIBLE CHAIR APPARATUS

BACKGROUND OF THE INVENTION

This invention relates to an improved chair apparatus that is designed for use in a kneeling position and is reversible for utilization in the normal seated position.

Both chairs and kneeling apparatus have been known in the art for quite some time. Several so called "posture" chairs have been disclosed which are designed to rotate hips foward aligning back with gravity, leaving internal organs in an uncramped position, and to distribute the weight from the user's posterior to the user's knees. For example, stationary chairs consisting of permanently fixed seats and kneeling pads or partially movable seats and kneelers have been designed. An example of a fixed "posture" chair with a partially movable seat and kneeling pad is disclosed in Vowles U.S. Pat. No. 3,669,493 which utilizes a complicated, structurally intricate, mechanism to provide a movable seat and kneeler in order to provide a variety of kneeling positions. Rocking chair "posture" chairs are also known in the art as exemplified by Mengshoel et al U.S. Pat. No. 4,328,991. The Mengshoel et al patent discloses a sitting device which serves as an ordinary bench when sitting normally or which may be rocked forward so that the knees may be rested on to two individual kneeling pads.

A drawback to the "posture" chairs known in the art is that a conventional seating option which includes a back rest is not available. Further, the adjustable nature of the prior art "posture" chairs is limited by the complexity of steps necessary to make the adjustment. An additional drawback to "posture" chairs known in the art is that the knee rests either flex laterally individually, as in the Mengshoel device described above, thereby causing one or both knees to slip and possibly throwing the user off balance or provided no flexibility when the knee rest was a single unit, as in the Vowles patent described above. Further, configuration of chairs in the prior art resulted in joints which were susceptible to deterioration at the joints as a result of racking, as when a person leans back in a straight backed chair. Additionally, there is no means provided in the art of "posture" chairs for a support stand attached to the kneeler of such a chair to hold items in front of the user of a "posture" chair. Thus, there is a need in the art for providing a combination chair and "posture" chair which provides for conventional seating, for simple multiple adjustments between the seat and knee rest when the chair is utilized in its "posture" chair mode, for a flexible, unitized, stable knee rest, which has non-racking joints and which, among other things, provides for a support stand attached to the kneeler to hold items in front of the user of such a "posture" chair. It, therefore, is an object of this invention to provide an improved combination conventional and "posture" chair which meets these and other needs as hereafter more fully described.

SUMMARY OF THE INVENTION

Accordingly, the construction of the combination conventional and "posture" chair includes a frame having a center strut which is pivotably connected to the frame by any ordinary securing means at what forms the apex of the triangularly shaped base of said frame. A cushion means is secured to the center strut on the end of the center strut opposite from the end connected to the frame. The cushion means on the center strut provides support for the posterior of the user in both the conventional and the "posture" chair configuration. A second strut assembly, hereafter called the "adjustable" strut assembly to the two legs of the frame decending from the apex of the frame forms a triangular base for the chair. A cushion means is attached to the adjustable strut assembly and forms the kneeler when the invention is in the "posture" chair configuration and the back rest when the chair is in conventional form. A means for interconnecting the center strut and the adjustable strut assembly is provided so that a plurality of "posture" chair positions is provided. Further, the unitary knee rest is flexible as a unit thereby allowing comfortable and safe weight shifts when seated. Casters on the three points of the frame triangle provide for a pivotable and mobile chair in either configuration and allows the chair to rest securely even on non-level floors. The device is easily also adjustable to different seating preferences adjustable to a plurality of positions for individuals of differing size and height. Foot rests are provided in either the "posture" chair or the conventional chair mode.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
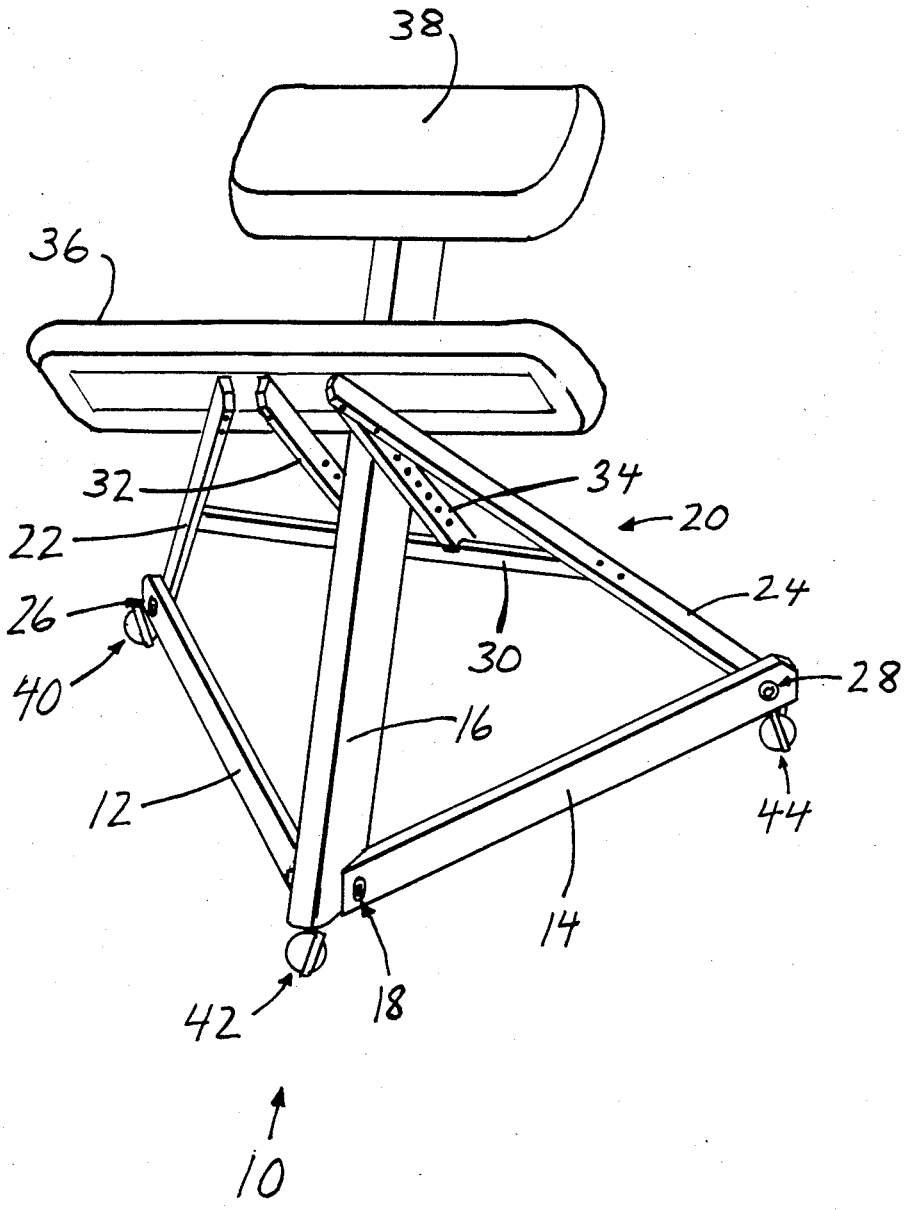
FIG. 1 is a front view of a preferred embodiment of the portable reversible chair of the present invention shown in the "posture" chair position.

The preferred embodiment of the present invention is illustrated by way of example in FIGS. 1–10. Identical reference characters will be utilized to refer to identical or equivalent structures throughout the various views and the following detailed description. With specific reference to FIGS. 1, 2 and 3, the invention 10 is disclosed. The frame of the invention 10 is composed of frame legs 12 and 14. Center strut 16 is pivotally connected to frame legs 12 and 14 by means of a pivoting connector assembly 18 of ordinary design, such as a bolt, washers and a nut, or of any conventional design known in the art. This connection of center strut 16 and frame legs 12 and 14 form the apex of a tetrahedron. A second strut assembly, hereafter described as the "adjustable" assembly 20 has two adjustment strut legs 22 and 24 which are pivotally connected by pivoting connector assemblies 26 and 28, in the same manner as pivotal connector assembly 18, with frame legs 12 and 14 respectively. These adjustment strut legs 22 and 24 are connected by "posture" foot rest 30 which, in addition to serving as a foot rest for the invention when it is in the "posture" chair configuration, also adds rigidity to the structure. Two parallel adjustment members 32 and 34 are securedly attached to the "posture" foot rest 30. Cushion 36 is securely attached to the four free ends of adjustment strut legs 22 and 24 and adjustment members 32 and 34. Adjustable strut assembly 20, then, is composed of six elements, those being the two adjustment strut legs 22 and 24, the two parallel adjustment members 32 and 34, "posture" foot rest, and strengthening member, 30 and cushion 36. As will be more fully described hereafter, cushion 36 serves as a kneeler when the device is in its "posture" chair configuration and as a back rest when the device is in its conventional chair configuration. Cushion 38 is attached to the free end of center strut 16 and forms a cushion for the user's posterior in both the "posture" chair and conventional chair configurations of the device. Three ball caster assemblies 40, 42 and 44 provide for mobility and pivoting of invention 10. Ball caster assemblies 40 and 44 are connected to frame legs 12 and 14 respectively and ball caster assembly 42 is connected to center strut 16. The ball caster assemblies are of conventional design and are shown as such a ball caster assembly in this illustration.

Figure 2:
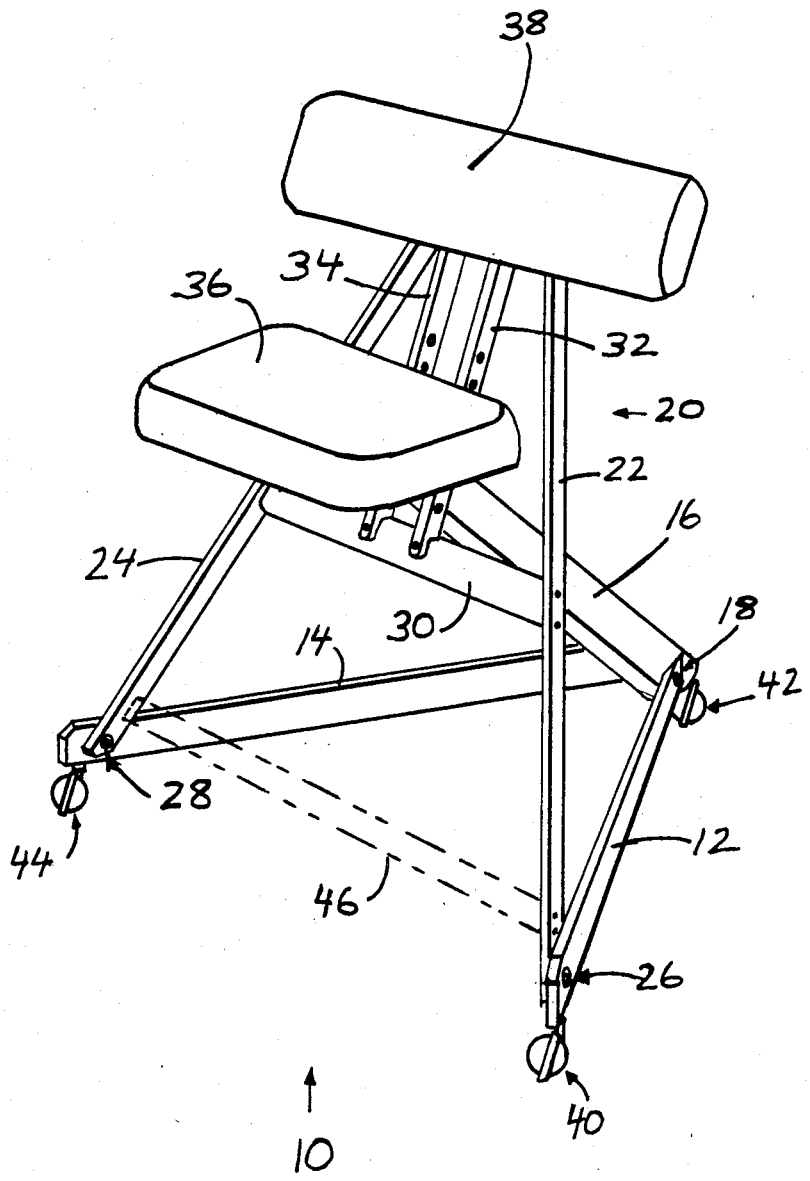
FIG. 2 is a front view of a preferred embodiment of the present invention shown in the conventional chair configuration.

Referring specifically to FIG. 2, device 10 is shown in the conventional chair configuration. FIG. 2 also illustrates another preferred embodiment of device 10 wherein conventional foot rest 46 is provided. This conventional foot rest 46, when added, is for the convenience of the user. It is not needed for strength since the triangular construction of the device assures the rigidity of the frame, even though any single connection may pivot freely at the vertices of the tetrahedron formed by pivotal connectors 18, 26, 28 and the connection between center strut 16 and adjustable strut 20, more fully described hereafter in FIG. 3. The weight of the user sitting on the chair in either configuration is distributed uniformily throughout the frame making this invention extremely strong for the size of its frame members.

Figure 3:
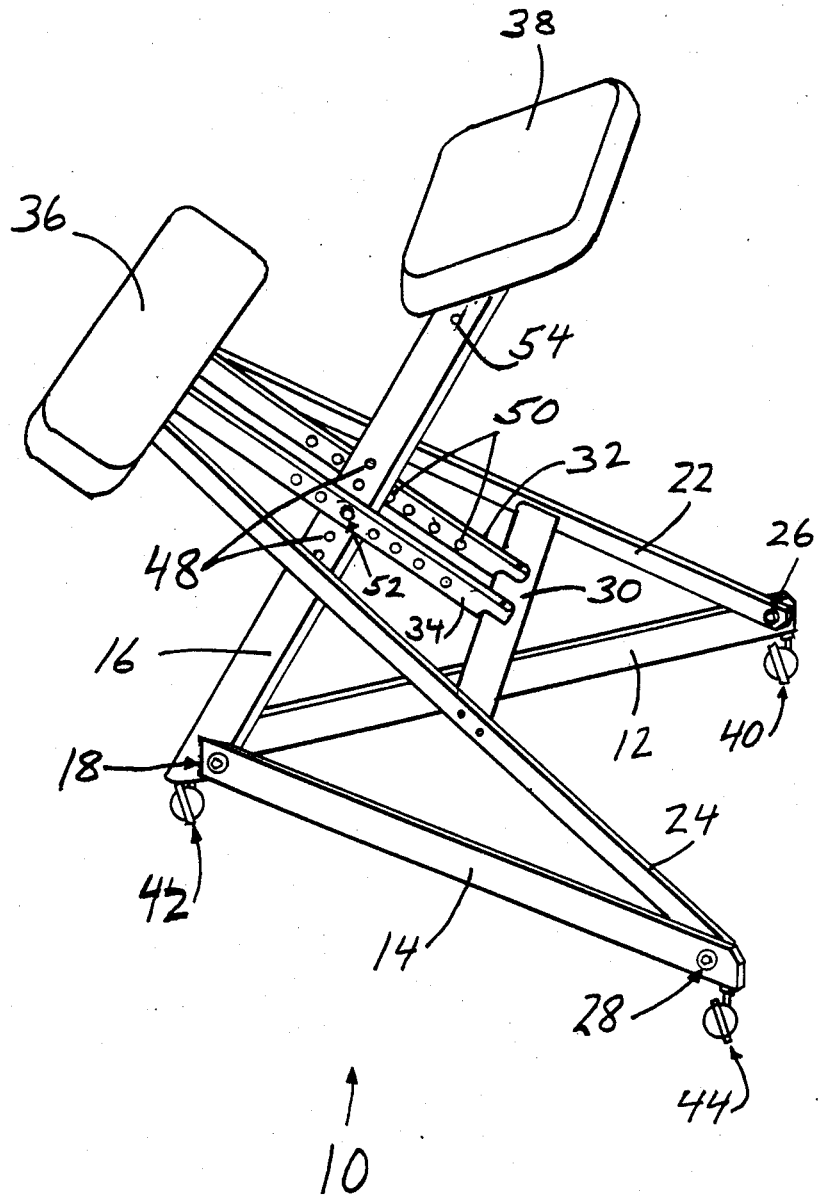
FIG. 3 is a side view of a preferred embodiment of the invention shown in the "posture" chair configuration illustrating variable adjustment holes in the center and adjustable struts.

Referring now to FIG. 3, in the preferred embodiment five adjustment holes 48 are provided in center strut 16 and seven adjustment holes 50 are provided in adjustment members 32 and 34. A lock pin assembly 52 is provided which securely connects center strut 16 and adjustable strut assembly 20 to form the fourth freely pivoting vertice of the tetrahedron. As can be seen by this illustration, adjustment of the device 10 is along two axes defined by center strut 16 and adjustment strut assembly 20. As disclosed in this preferred embodiment, adjustments enabled by the adjustment holes 48 and 50 allow comfortable use of the device by users ranging in height from three feet six inches to seven feet or better. When in the "posture" chair configuration as shown in FIG. 3, cushion 38 may be inclined in a variety of positions by movement of center strut 16 along the adjustable strut assembly 20 axis formed by adjustment members 32 and 34. The distance between cushion 38 and cushion 36, serving as a kneeler in the "posture" chair configuration shown in this FIG. 3, is adjusted by movement along center strut 16. As can be seen in this preferred embodiment, the position of the struts once adjusted is secured by inserting lock pin assembly 52 through aligned adjustment holes 48 and 50 in the center strut 16 and adjustment members 32 and 34.

Figure 4:
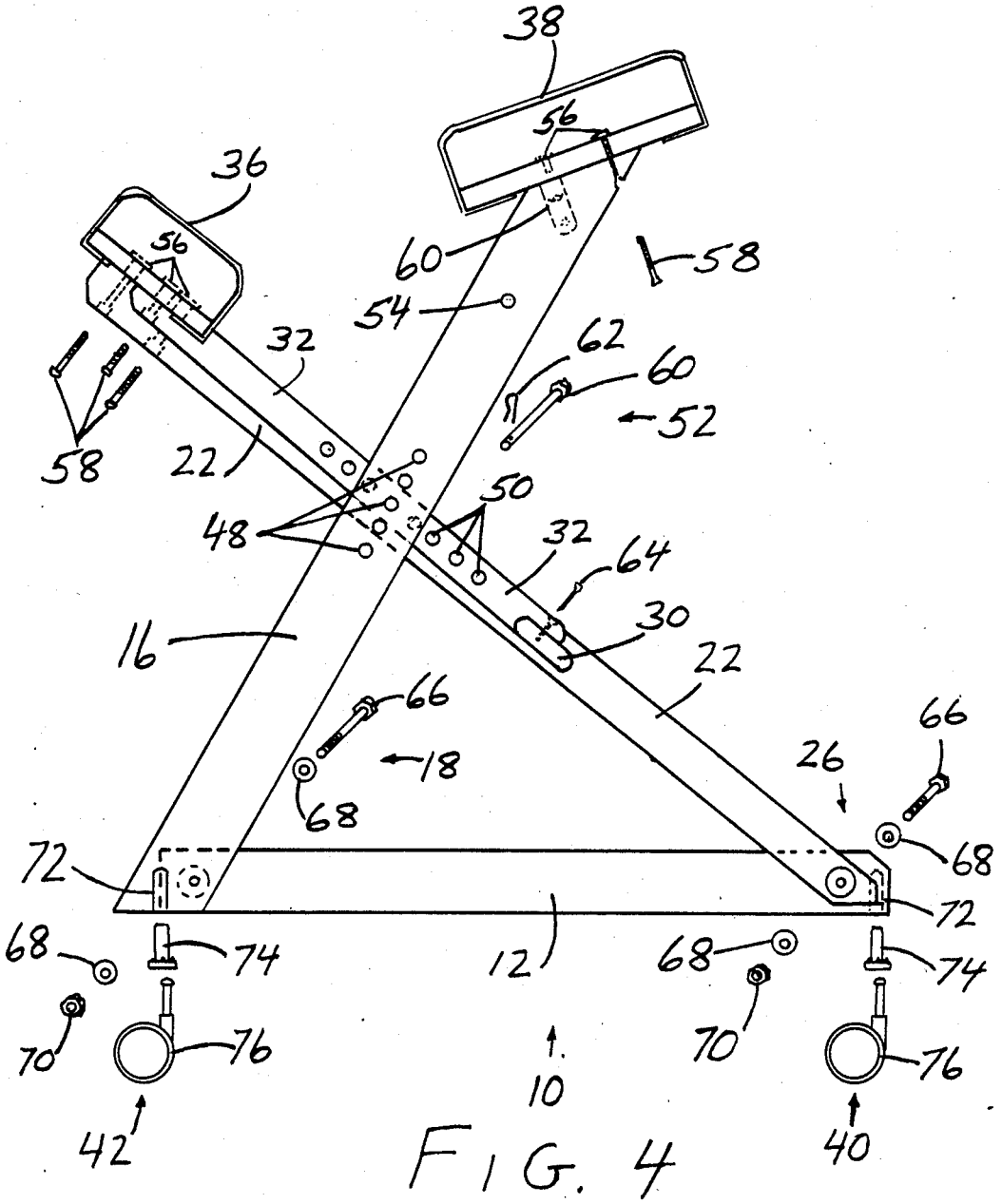
FIG. 4 is a section view showing one-half of the device.

Referring to FIG. 4, a cut away side view of one-half of the device 10 is disclosed. The five adjustment holes 48 in center strut 16 are clearly illustrated. Also illustrated is conventional chair configuration hole 54, more fully described hereafter in FIG. 6. Also illustrated in FIG. 4 is a means for securing cushion 38 to center strut 16. In the preferred embodiment this consists of T-nuts 56 located on the interior base of cushion 38 and used in combination with bolts 58 and support angle 60 to secure the cushion 38 to central strut 16. The preferred embodiment for attaching one-half of cushion 36 is also shown where three T-nuts 56, working in combination with two bolts 58 in adjustment strut leg 22 and one bolt in adjustment member 32, secure cushion 36 to adjustable strut assembly 20.

All seven adjustable strut assembly holes 50 are also illustrated in FIG. 4. Also, lock pin assembly 52 is illustrated in its preferred embodiment consisting of lock pin 60 and safety clip 62.

FIG. 4 provides further illustration of the construction of device 10, wherein wood screw 64 is shown securing adjustment member 32 to "posture" foot rest 30. Pivotal connector assemblies 18 and 26 are illustrated consisting of bolts 66 washers 68 and nuts 70. Additionally, ball caster assemblies 40 and 42 are illustrated consisting of caster sleeve recesses 72, caster sleeves 74 and ball casters 76.

Figure 5:
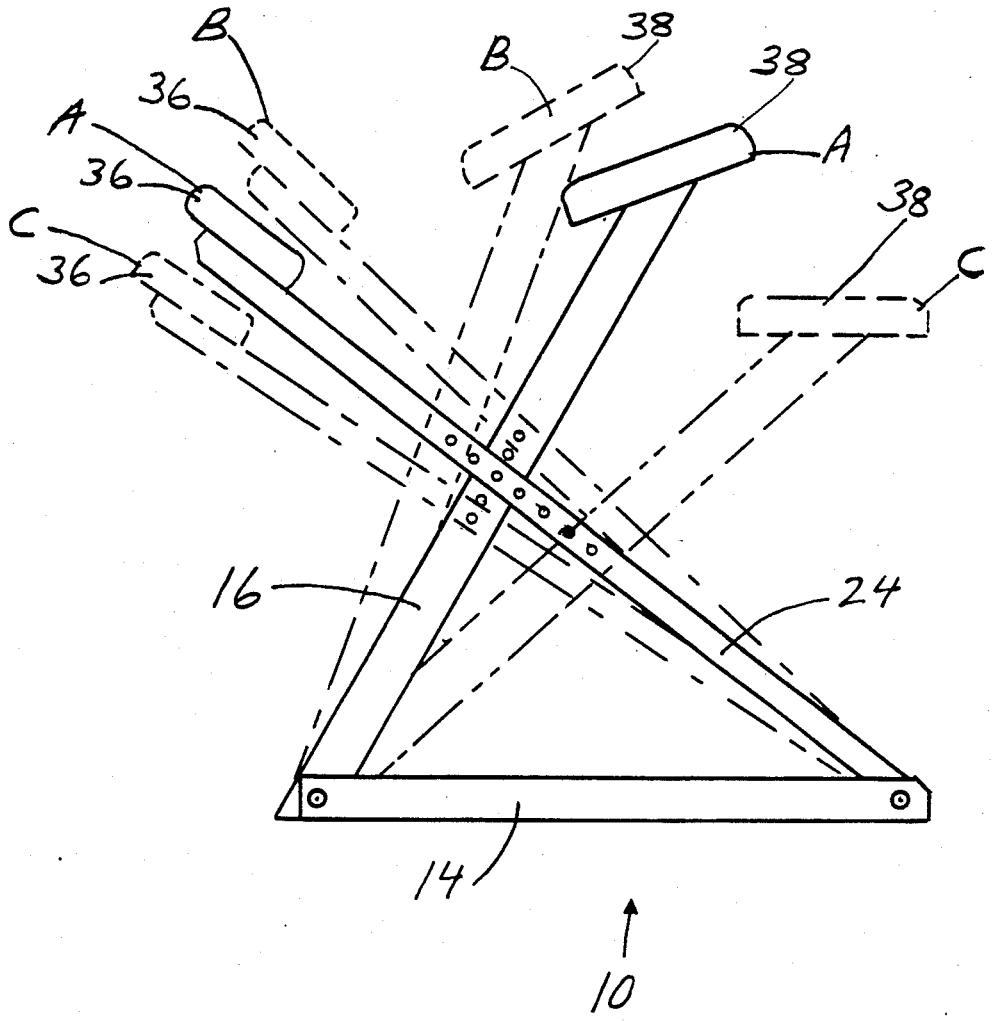
FIG. 5 is a side schematic view illustrating the extremes of positions available in the "posture" chair configuration for short and tall people.

Referring to FIG. 5, device 10 is illustrated in "posture" chair configuration beginning with mid range configuration A, small configuration B and extreme configuration C.

Figure 6:
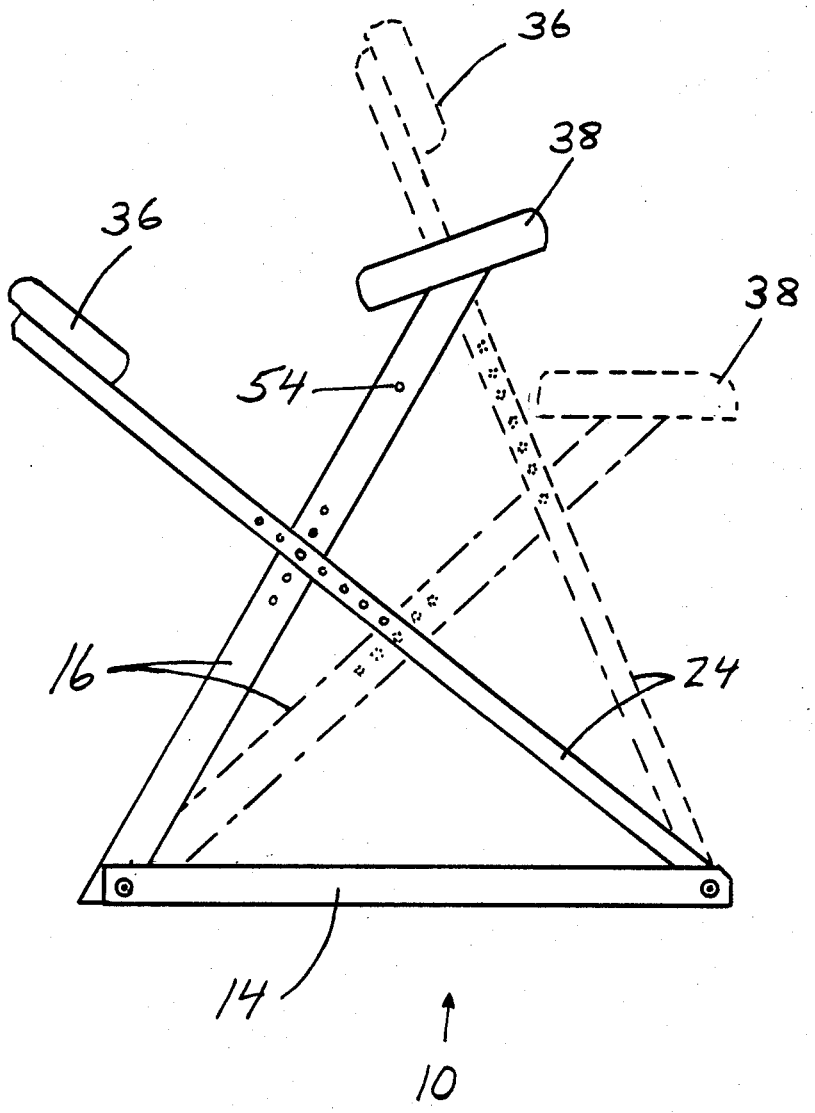
FIG. 6 is a side schematic view illustrating the conversion of the invention from the "posture" chair to the conventional chair configuration.
Figure 7:
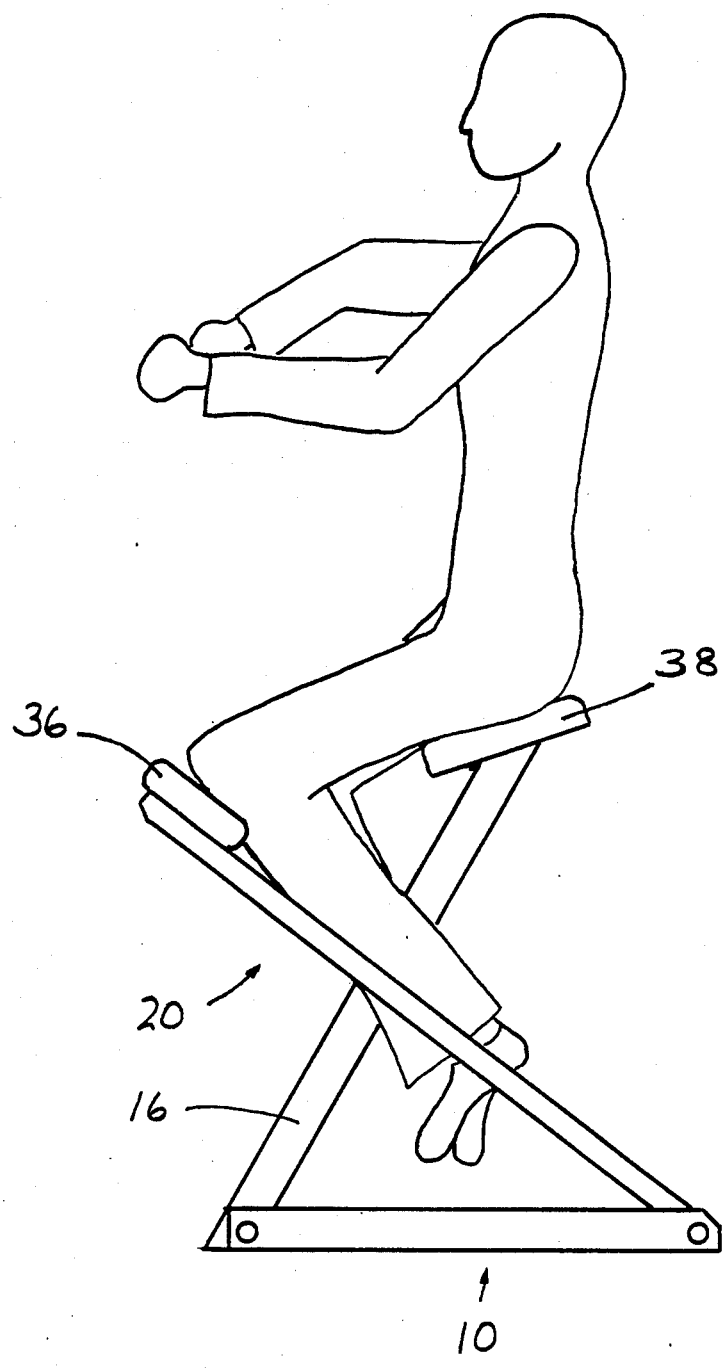
FIG. 7 is a side illustration of a person using the invention in the "posture" chair configuration.
Figure 8:
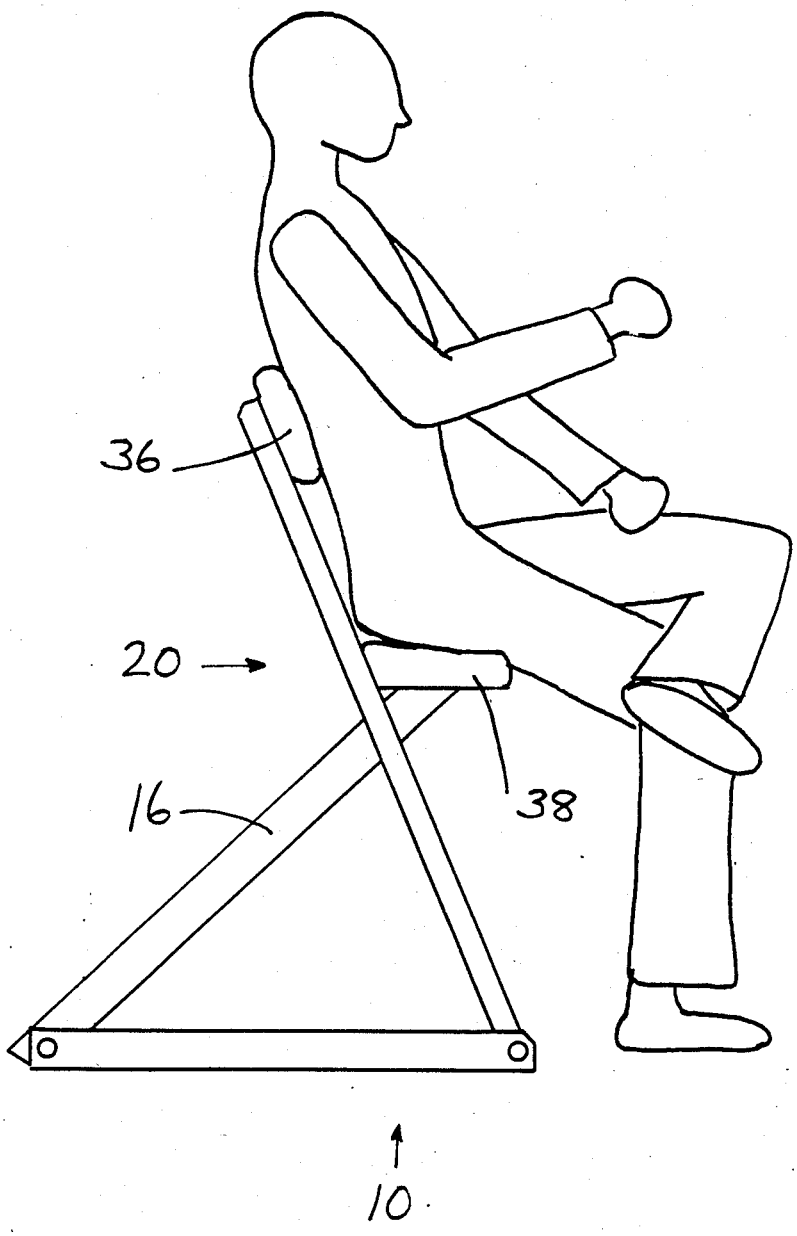
FIG. 8 is a side view illustrating a user seated in the invention in its conventional chair configuration.

FIG. 6 illustrates the reversable nature of device 10. The solid lines illustrate device 10 in the "posture" chair configuration. As illustrated, device 10 may be reversed to form a conventional chair by removing lock pin assembly 52 rotating center strut 16 down and adjustable strut assembly 20 upward until the bottom most adjustment hole 50 in the adjustment strut assembly 20 coincides with chair configuration hole 54. Insertion of lock pin assembly 52 completes the reversal from the "posture" chair configuration to the conventional chair configuration wherein cushion 38 forms a conventional seat for the posterior of the user parallel to the ground and cushion 36 forms a conventional back rest. This reversal proceedure takes only seconds. FIGS. 7 and 8 illustrate a user utilizing device 10 in the "posture" chair configuration and in the conventional chair configuration, respectively.

Figure 9:
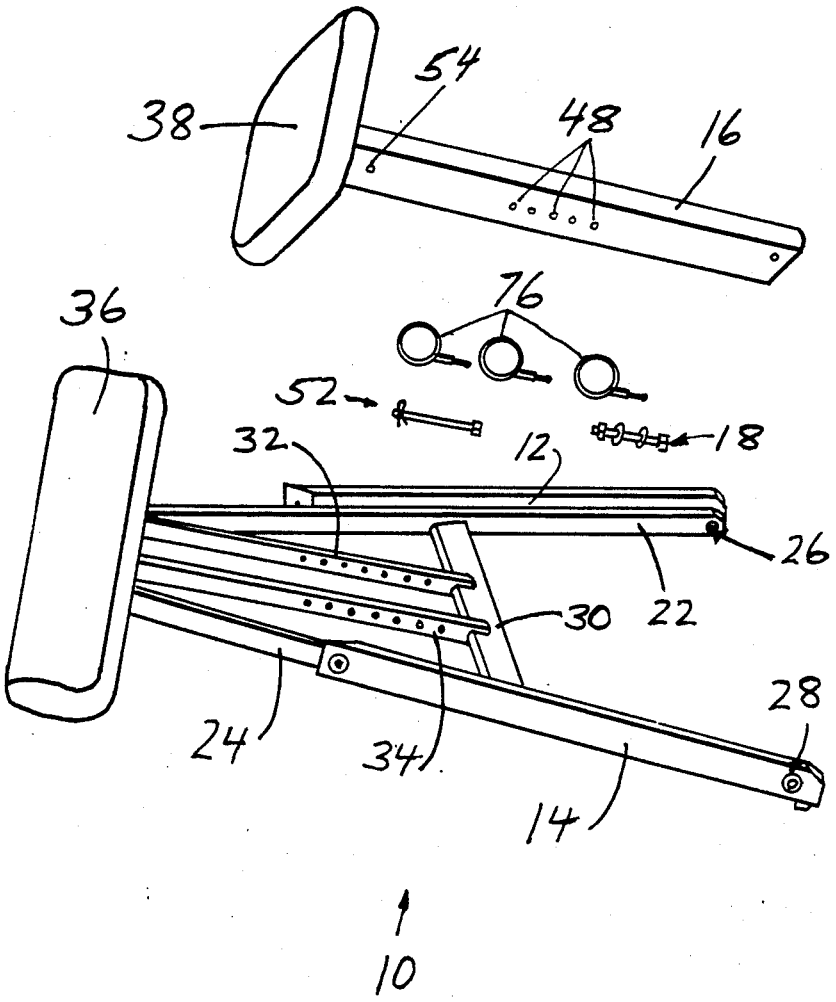
FIG. 9 is an exploded view of the device disassembled and ready for shipping.

FIG. 9 illustrates device 10 disassembled for storage or shipping. As illustrated in FIG. 9, removal of the apex pivotal connector assembly 18 enables frame legs 12 and 14 to pivot alongside of and parallel to adjustment strut legs 22 and 24 to form a virtually flat form. Removal of lock pin assembly 52 enables the user to remove center strut 16 and removal of ball casters 76 completes disassembly for storage or shipping.

Figure 10:
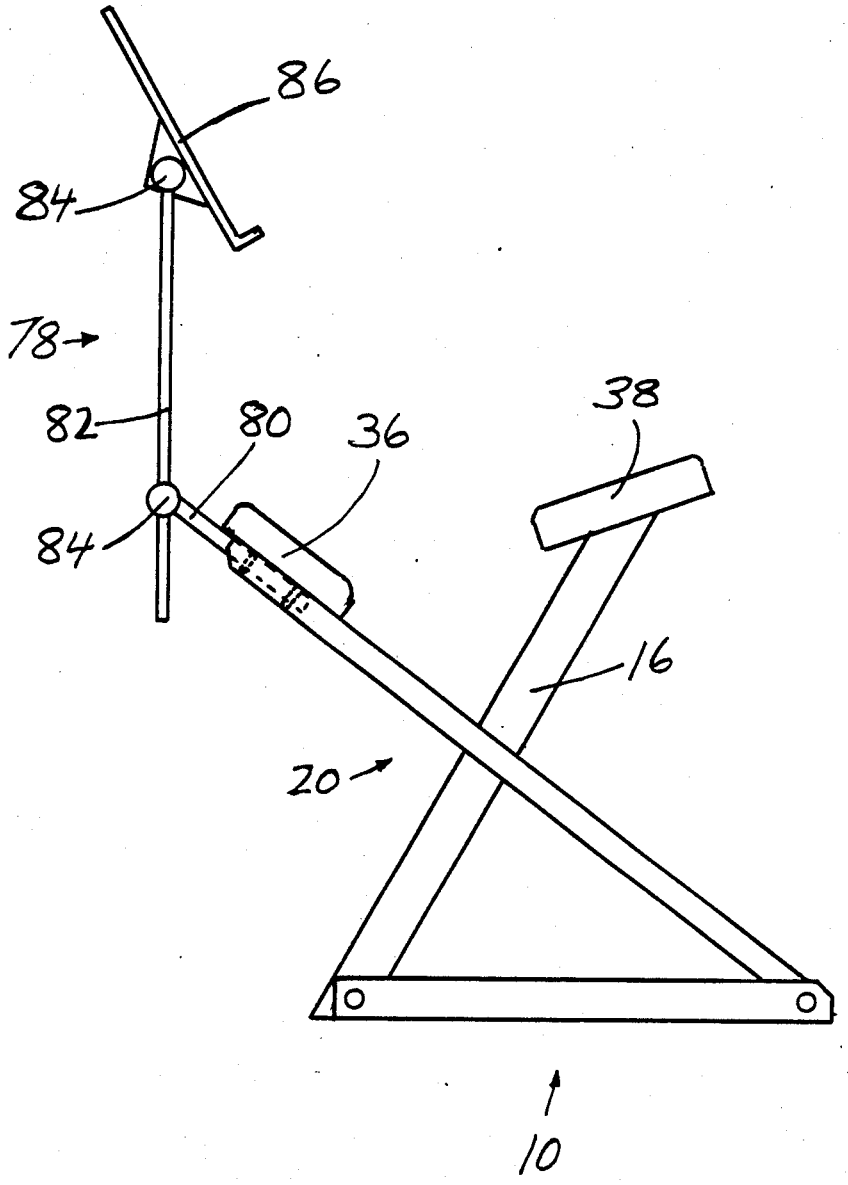
FIG. 10 is a side illustration of the device in the "posture" chair configuration showing the adjustable support means attached to the kneeler.

FIG. 10 illustrates the device 10 in the "posture" chair configuration. Also disclosed in FIG. 10 is the preferred embodiment of the device when in this position in conjunction with support stand 78. The support stand 78 is shown with retaining means 80 attached to adjustable strut assembly 20 and the base of cushion 36 by conventional means, such as nuts and bolts. A stand support rod 82 is shown passing through, and held in position by, frictional restraining means 84. The frictional restraining means 84 is of any ordinary design commonly available and known in the art. A stand platform 86 is attached to the stand support rod 82 by means of another frictional retaining means 84. As illustrated, it is clear that device 10 when in "posture" chair configuration with stand support means 78 in place enables the user to read music placed on the stand or hold items on the stand closely in front of him.

In its preferred embodiment, device 10 is constructed primarily of wood. Because of the design structure of the device full advantage is taken of the unique properties of wood in that wood is stronger in tension than in compression, the ratio of load to deflection is constant over the entire elastic range meaning that wood does not loose its resiliency, and wood is relatively cheap, available and easy to work. However, it should be understood that device 10 may be produced from a variety of materials, including wood, such as various metal alloys, plastics, fiberglass, and carbon graphite, to name a few. The present invention provides an improved "posture" chair and a unique combination "posture" chair and conventional chair by means of its easily reversible configuration. The invention is mobil and pivots easily, it is rapidly and simply changed to a plurality of heights and is easy to mount and dismount. The long unitary kneeler, separately secured at four distinct locations, provides verticle flexing of the knee rest thereby enabling the user to easily and simply shift positions either while seated or while mounting or dismounting the device. As a result of the geometry of the construction of the device it provides an extremely stable base freeing the user from annoying and possibly dangerous imbalances. Thus, the construction of the present invention has the important advantage of providing safety to the user thereof.

While the present invention has been disclosed in connection with the preferred embodiment thereof, it should be understood that there may be other embodiments which fall within the spirit and scope of the invention as defined by the following claims.

What is claimed is:

1. A portable, reversible chair comprising:

(a) a three point triangular base with caster means attached to said three point base so that said base is stable on uneven surfaces and may be easily pivoted and rotated without having to get off of and pick up said base;

(b) a single center strut with one end rotatably connected to the apex of said triangularly shaped base;

(c) a first cushion means fixedly secured to the free end of said center strut for providing support to the posterior of a user in both a conventional chair configuration and a posture chair configuration;

(d) an adjustable strut assembly with two legs that pass down either side of said center strut wherein one of said two legs is rotatably attached to one end of said triangular base opposite from said apex and wherein the other one of said two legs is rotatably attached to the other end of said triangular base opposite from said apex;

(e) a second cushion means fixedly secured to said adjustable strut assembly so that the knees of said user are supported by said second cushion means in one set of positions and the back of said user is supported by said second cushion means in another set of postions; and (f) a means interconnecting said center strut and said adjustable strut assembly for securing said center strut and said adjustable strut assembly in a plurality of positions so that a range of conventional positions and a range of posture positions are provided for users of various heights.

2. The portable, reversible chair of claim 1 wherein said interconnecting means comprises a single positive locking means whereby a locking pin is passed through one set of a plurality of adjustment holes in said adjustable strut assembly which have been aligned with one of a plurality of adjustment holes in said center strut and said locking pin is positively retained in this position by a retaining clip means so that said locking pin cannot slip out of the chosen position.

3. The portable, reversible chair of claim 2 wherein said adjustable strut assembly has seven sets of holes and said ceneter strut has five holes so that said first cushion may be inclined in a plurality of positions by removing said positive locking means, moving said center strut along the axis formed by said two legs of said adjustable strut assembly and reinserting said positive locking means so that the distance between said first cushion and said second cushion, serving as a kneeler in this posture chair configuration, can be adjusted to fit both children and adults.

4. The portable, reversible chair of claim 3 wherein a conventional chair configuration is provided by removing said positive locking means, rotating said center strut down and said adjustable strut assembly upward until the bottom most of said adjustment holes in said adjustable strut assembly coincides with a chair configuration hole located at said first cushion end of said center strut and inserting said positive locking means so that said first cushion means forms a conventional seat, parallel to the ground, and said second cushion means forms a conventional back rest for a user.

5. The portable, reversible chair of claim 4 wherein a foot rest is provided comprising a cross member connected to said two adjustable strut assembly legs just above said connection of said legs to said triangular base so that a foot rest is provided when said reversible chair is in said conventional chair configuration.

6. The portable, reversible chair of claim 5 wherein said portable, reversible chair is collapsible by means of removing said locking means and said means rotatably attaching said adjustable strut assembly legs to said triangular base so that said center strut is detached and said legs of said triangular base are folded up along side of said two legs of said adjustable strut assembly thereby forming a virtually flat portable, adjustable chair, with foot and back rests, for transportation.

* * * * *